US007819340B2

(12) United States Patent
Mueller et al.

(10) Patent No.: US 7,819,340 B2
(45) **Date of Patent: *Oct. 26, 2010**

(54) CLEANING SPRAY NOZZLE

(75) Inventors: John R. Mueller, Wauwatosa, WI (US); Patricia M. Mueller, Wauwatosa, WI (US)

(73) Assignee: Idea Factory, Inc., Menomonee Falls, WI (US)

( * ) Notice: Subject to any disclaimer, the term of this patent is extended or adjusted under 35 U.S.C. 154(b) by 200 days.

This patent is subject to a terminal disclaimer.

(21) Appl. No.: 11/576,861

(22) PCT Filed: Oct. 6, 2005

(86) PCT No.: PCT/US2005/036189

§ 371 (c)(1),
(2), (4) Date: Apr. 6, 2007

(87) PCT Pub. No.: WO2006/042127

PCT Pub. Date: Apr. 20, 2006

(65) Prior Publication Data

US 2008/0035757 A1 Feb. 14, 2008

(51) Int. Cl.
*A62C 5/02* (2006.01)
*B05B 7/26* (2006.01)
*B05B 7/14* (2006.01)

(52) U.S. Cl. ..... 239/310; 239/315; 239/318; 239/526; 239/588; 239/375

(58) Field of Classification Search ..... 239/310, 239/353, 354, 361, 367, 344, 302, 303, 304, 239/305, 316, 407, 413, 569, 581.1, 581.2, 239/433, 525
See application file for complete search history.

(56) References Cited

U.S. PATENT DOCUMENTS

| | | | | |
|---|---|---|---|---|
| 3,554,450 | A * | 1/1971 | D'Muhala | 239/309 |
| 4,558,823 | A * | 12/1985 | Groth | 239/413 |
| 5,881,955 | A * | 3/1999 | Styne | 239/310 |
| 6,708,901 | B2 * | 3/2004 | Hubmann et al. | 239/310 |
| 7,124,962 | B1 * | 10/2006 | Fryan et al. | 239/318 |
| 7,156,324 | B2 * | 1/2007 | Birrenkott et al. | 239/345 |
| 7,188,787 | B2 * | 3/2007 | Cannon et al. | 239/526 |
| 7,410,105 | B2 * | 8/2008 | Horstman et al. | 239/315 |
| 7,490,783 | B2 * | 2/2009 | Mueller et al. | 239/315 |

* cited by examiner

*Primary Examiner*—Len Tran
*Assistant Examiner*—James S Hogan
(74) *Attorney, Agent, or Firm*—Joseph S. Heino; Patrick M. Bergin

(57) ABSTRACT

A spray nozzle (10) has a nozzle body (20) with an inlet (24) and an outlet (26). The inlet (24) is attachable to a hose (2). The outlet (26) is configured to receive a chemically-containing cartridge (70). A forwardly-disposed trigger (30) is finger-actuated and operates the valve (52) of a first valve assembly (50) to control water flow through the nozzle (10). An inlet conduit (56) connects the first valve assembly (50) to a second valve assembly (60). The second valve assembly (60) is thumb-actuated by a toggle (40) to pass water through the nozzle (10) as clean water supplied to the nozzle (10) via the hose (2) or through the nozzle (10) as chemical-added water that is created by a venturi-induced assembly (80) contained within the cartridge (70).

15 Claims, 7 Drawing Sheets

CLEANING SPRAY NOZZLE

FIELD OF THE INVENTION

The present invention relates generally to spray nozzles. More specifically, it relates to a cleaning spray nozzle having a replaceable cartridge that is used to selectively disperse a chemical, such as a soap, into a water stream flowing from the spray nozzle.

BACKGROUND OF THE INVENTION

In order to direct pressurized streams of water into specific locations to clean a surface or a container, spray nozzles are often utilized. These nozzles typically include a water inlet end adapted to be connected to a water source, such as a hose, and a water outlet end spaced from the inlet end and through which the pressurized stream of water is dispensed. The inlet end and outlet end are connected by a conduit that is contained within the nozzle and through which the water flows.

To operate the nozzle, certain nozzles have manually depressible triggers disposed on the exterior of the nozzle. When depressed, the trigger actuates a valve assembly disposed on the conduit within the nozzle that allows water entering the nozzle from the inlet to flow through the conduit and the valve assembly and out of the outlet end. The dispensing of water from the nozzle can also be controlled by a rotatable member disposed about the exterior of the outlet end of the housing, and capable of moving towards or away from a fixed portion of the housing which obstructs an opening extending through the rotatable member.

Regardless of the type of operating mechanism utilized for the nozzle, certain nozzles also enable a chemical, such as a cleaning soap, to be dispensed with the water flowing through the nozzle. In certain prior art nozzles, the soap is fed to the outlet end through a separate conduit such that the water and soap are intermixed only at the outlet end of the nozzle. In other prior art designs, the soap or other chemical is positioned within a cavity disposed directly within the housing. The housing is disassembled in order to expose the cavity and allow the soap to be placed within the cavity. The cavity is then closed by reassembling the housing, and water flowing through the nozzle can contact the soap contained within a cavity for dispensing the soap along with the water flowing out of the nozzle.

Some of these prior art devices also include a dispensing mechanism for selecting the volume of the water stream flowing through the nozzle that contacts the soap contained on or within the nozzle. These means normally include a rotatable valve having a passage selectively alignable with the cavity or other container containing the soap, and through which the water stream flows. By turning the valve, an individual can select the amount of incoming water which contacts the soap to select the amount of soap being dispensed with the water stream from the nozzle.

These prior art nozzles do not typically disclose a nozzle in which the container holding the soap or other chemical is adapted to be easily and removably attached to the nozzle such that the container can be replaced as necessary. Also, the number of parts needed to construct the dispensing mechanism greatly increases the cost and complexity of these spray nozzles.

As a result, it is desirable to develop a hand-operable spray nozzle which includes a soap or chemical cartridge that is releasably attachable to the nozzle. The cartridge should also be selectively contactable with the water stream flowing through the nozzle using a simplified dispensing mechanism in order to dispense soap or other chemicals into the water stream in the desired amounts. Once the cartridge contents are spent, the cartridge should be easily and quickly replaceable by a cartridge having a fresh supply of soap or other chemical in it.

SUMMARY OF THE INVENTION

Accordingly, it is an object of the present invention to provide a manually-operable spray nozzle including a soap or chemical cartridge releasably attachable to the body of the nozzle. It is another object of the present invention to provide a spray nozzle in which the cartridge forms a part of the dispensing mechanism that mixes the soap within the cartridge with the outgoing water spray. It is still another object of the present invention to provide a nozzle in which the cartridge is generally translucent such that the amount of soap remaining within the cartridge can be easily determined. It is yet another object of the present invention to provide a nozzle wherein the cartridge can be replaced, if necessary, once the soap or chemical contents of the cartridge are spent. It is still a further object of the present invention to provide a spray nozzle that utilizes pressure differentials and one-way venting principles to draw the soap or chemical from a reservoir within the cartridge and into the water stream as it flows through the nozzle.

The present invention is an improved manually-operable spray nozzle including a nozzle body having an inlet end and an outlet end. The inlet end is selectively connected to a water source, such as a hose, and the outlet end allows the incoming water to be dispensed from the nozzle. To dispense the water, the nozzle includes an actuating member, such as a manually depressible trigger connected to a valve assembly which opens a water flow conduit extending from the inlet end to the outlet end allowing the water to exit the nozzle through the outlet end.

The nozzle also includes a detachable cartridge that is releasably attachable to the nozzle body in order to selectively dispense an amount of a chemical, such as a soap, disposed within the cartridge into the water stream flowing through the nozzle. The cartridge is uniquely configured to utilize the concepts of pressure differential and one-way venting to draw the chemical from the reservoir and into the water stream. The cartridge is replaceable and preferably translucent, in order to allow an operator of a nozzle to visually determine whether the cartridge is empty of the chemical, so that the cartridge can be removed and replaced. Further, the cartridge also includes or forms a part of a dispensing mechanism for allowing an amount of the chemical or soap contained within the cartridge, to mix with the water stream flowing through the nozzle. The various objects and advantages of the present invention will be made apparent from the following detailed description taken together with the drawings.

DETAILED DESCRIPTION OF THE INVENTION

Figure 1:
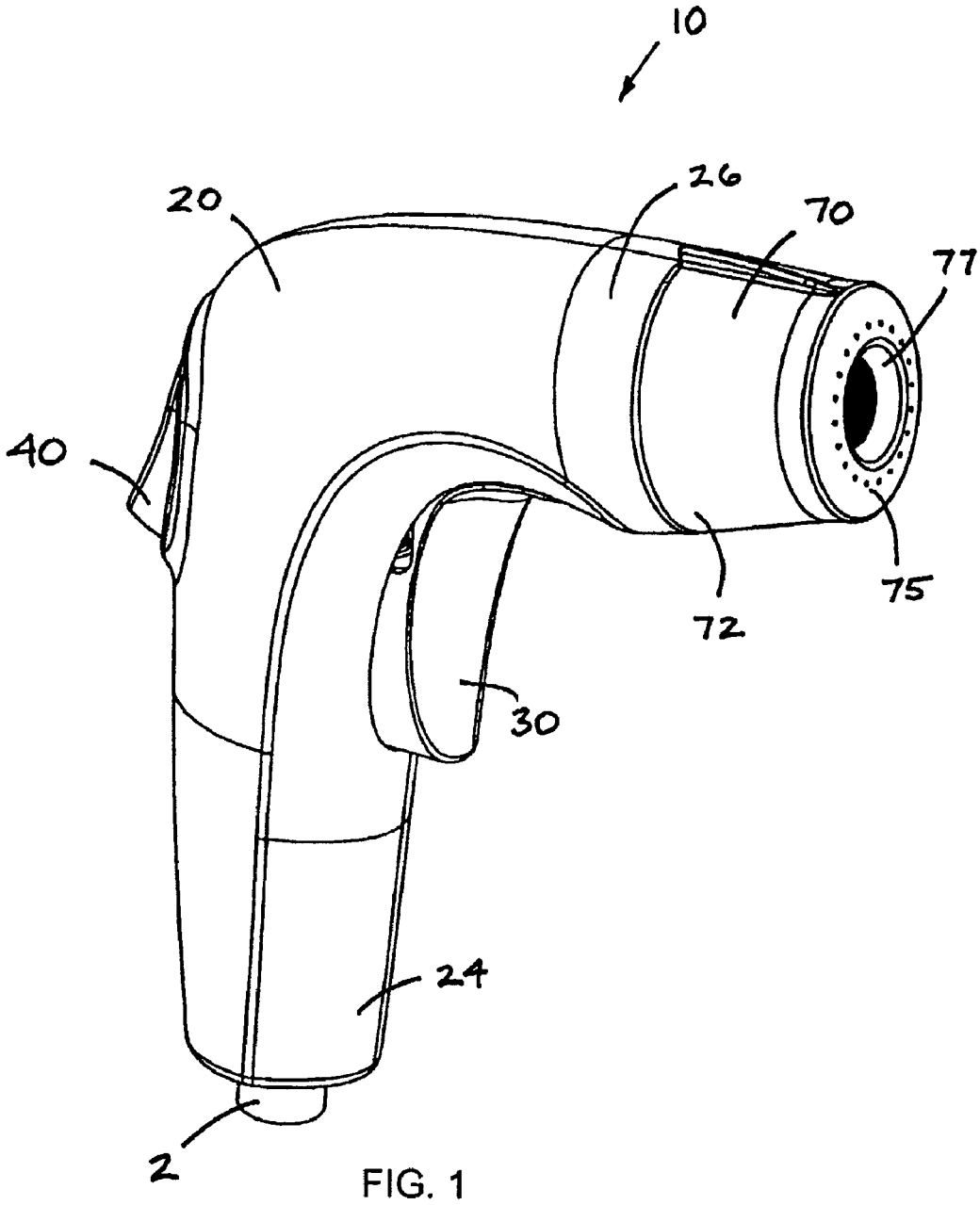
FIG. 1 is a top, front and left side perspective view of a spray nozzle constructed according to the present invention and showing a cartridge or container releasably attached to the body of the nozzle.
Figure 2:
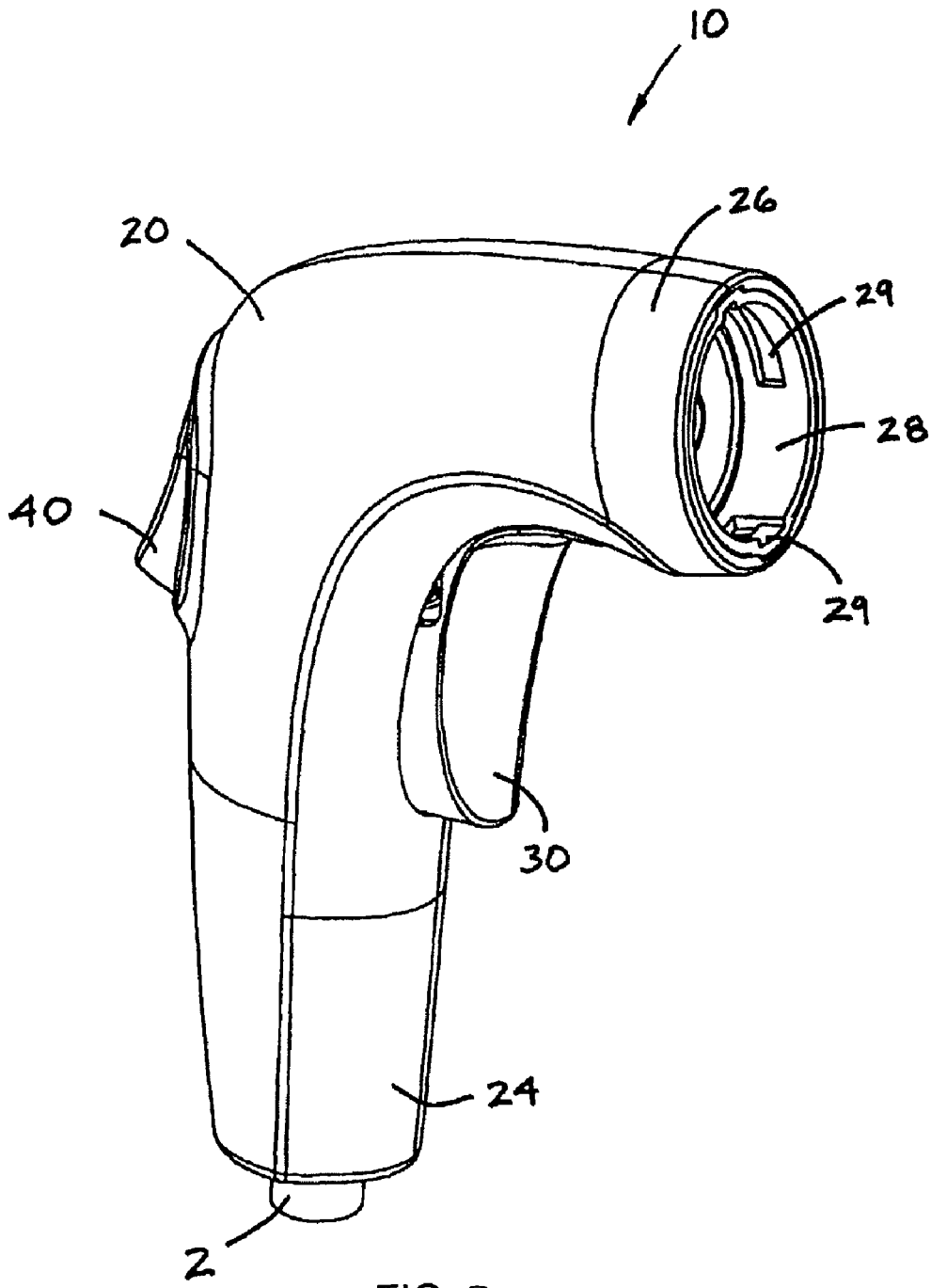
FIG. 2 is a top, front and left side perspective view of the spray nozzle shown in FIG. 1 and with the cartridge or container removed.
Figure 3:
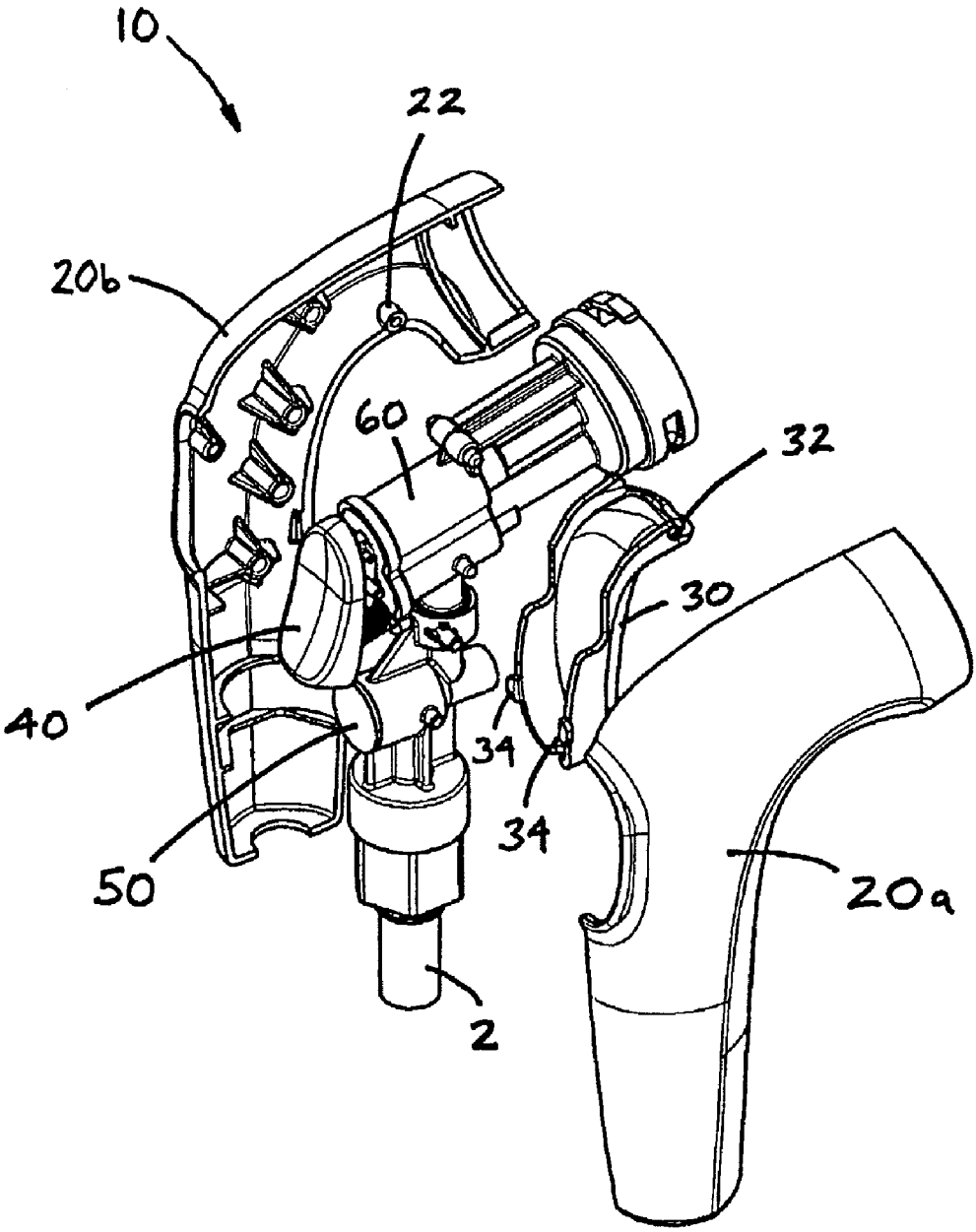
FIG. 3 is a top, rear and left side perspective and exploded view of the spray nozzle shown in FIG. 2.

Referring now to the drawings in detail wherein like numbers represent like elements throughout, FIG. 1 illustrates the preferred embodiment of a spray nozzle, generally identified 10, that is constructed in accordance with the present invention. As shown, the spray nozzle 10 is configured to be hand-held and includes a nozzle body 20, the nozzle body having an inlet end 24 and an outlet end 26. The inlet end 24 is connectable to one end of a hose 2. As shown in FIG. 2, the outlet end 26 of the nozzle body 20 includes an outlet end opening 28. The outlet end opening 28 is functionally adapted to receive a cartridge or container 70. See FIG. 1. Referring now to FIG. 3, it will be seen that the body 20 of the preferred embodiment is a hollow housing having a first body housing member 20*a* and a complementary second body housing member 20*b*. In the preferred embodiment, the housing members 20*a*, 20*b* are made of a molded plastic material and are secured together by conventional means. Neither the material or fastening means is a limitation of this invention.

Figure 5:
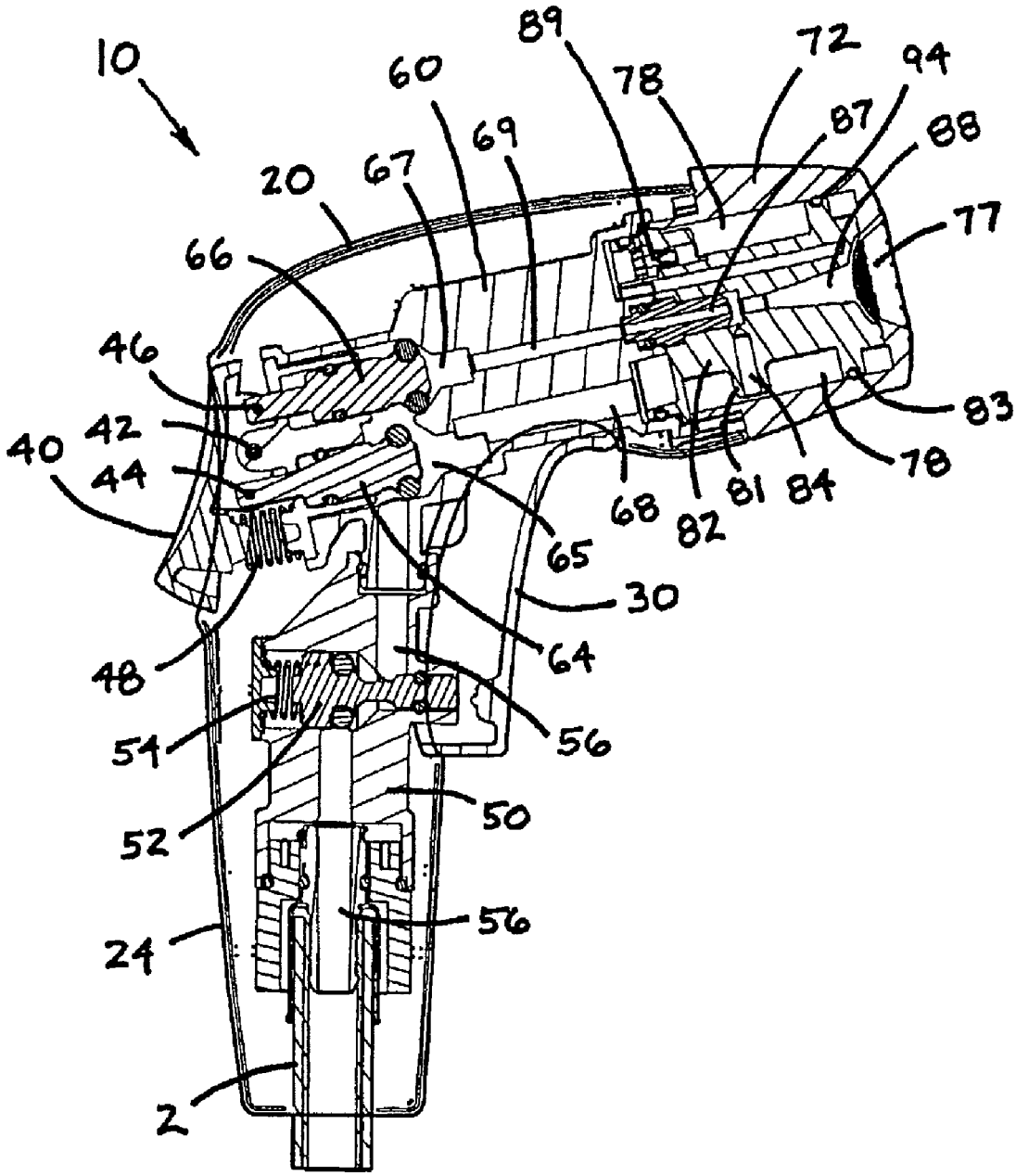
FIG. 5 is a cross-sectioned left side elevational view of a spray nozzle constructed in accordance with the present invention, showing the nozzle toggled to spray water only and showing the attached cartridge or container.

In order to operate the nozzle 10, the body 20 includes a forwardly-disposed trigger 30. The trigger 30 is intended to be finger-actuated and includes a pair of opposing trigger pivot points 32 and a pair of trigger stops 34, the stops 34 limiting the range of movement of the trigger 30. See FIG. 3. The trigger 30 is pivotally-secured within the assembled body 20 by the opposing pivot points 32 that are held within opposing pivot point receivers 22. It is to be understood, however, that the precise method of attachment of the trigger 30 to the body 20 is not a limitation of the present invention. The trigger 30 is operable to selectively actuate a water valve 52 and trigger valve spring 54 contained within a lower, or first, valve assembly 50. See FIG. 5. The trigger valve 52 is disposed within the body 20 to control the flow of water through an inlet water flow conduit 56 that extends between the inlet end 24 of the nozzle body 20 and an upper, or second, valve assembly 60.

The nozzle 10 also includes a toggle 40 that is intended to be thumb-operated for actuation of a chemical dispensing assembly which comprises the second valve assembly 60 contained within the nozzle body 20 and the cartridge 70. See FIG. 5. The toggle 40 is functionally adapted to slidably move a first toggle valve 64 and a second toggle valve 66 within the second valve assembly 60, the toggle 40 being pivoted about a pin 42 and being spring 48 loaded. The first toggle valve 64 slides longitudinally within a first valve cavity 65 and is anchored at one end to the toggle 40 by means of a first toggle pin 44. Similarly, the second toggle valve 66 slides longitudinally with a second valve cavity 67 and is anchored at one end to the toggle 40 by means of a second toggle pin 46.

Figure 6:
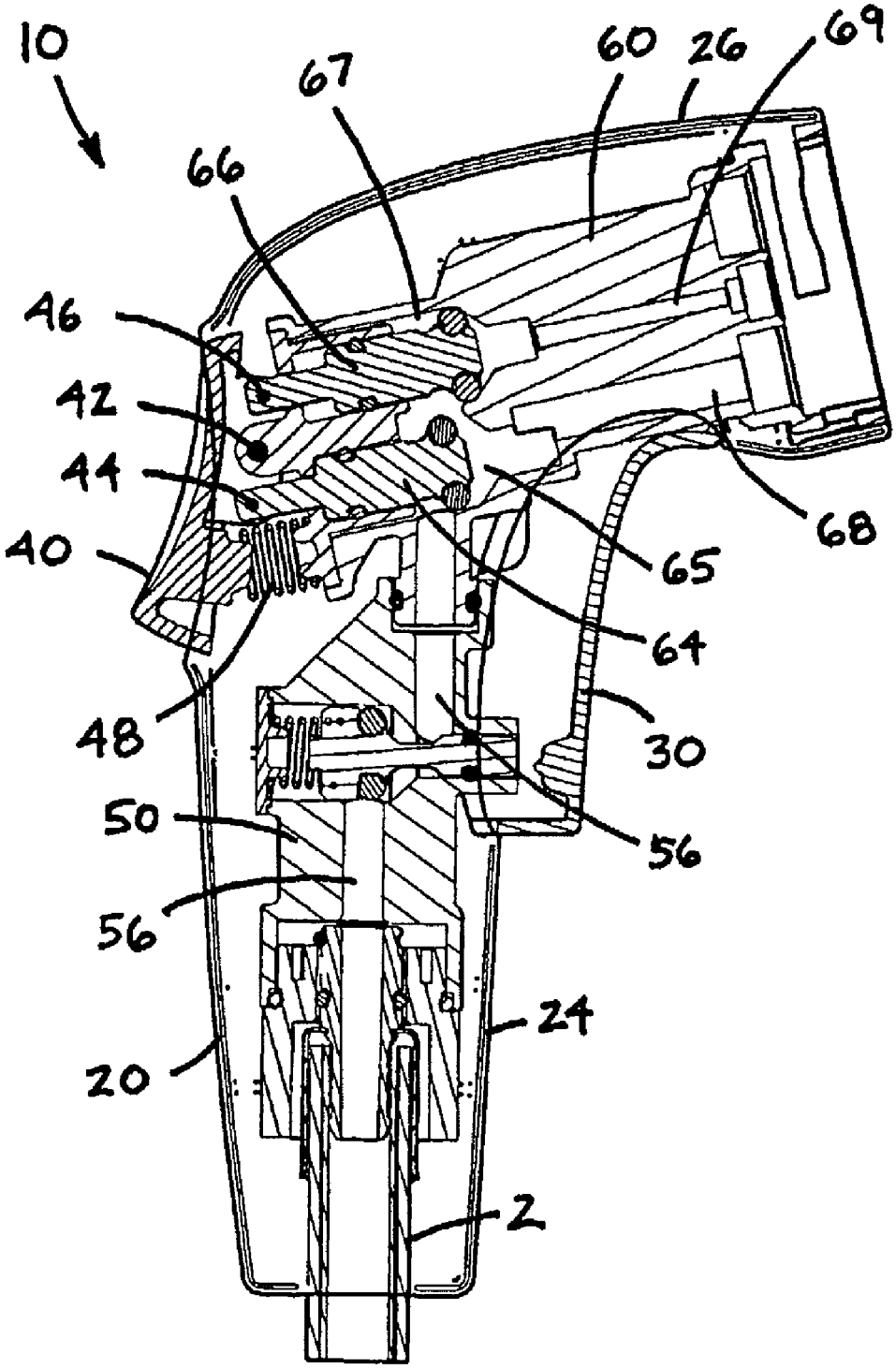
FIG. 6 is a cross-sectioned left side elevational view of the spray nozzle shown in FIG. 5, without the attached cartridge or container, and showing the nozzle toggled to spray water only.
Figure 7:
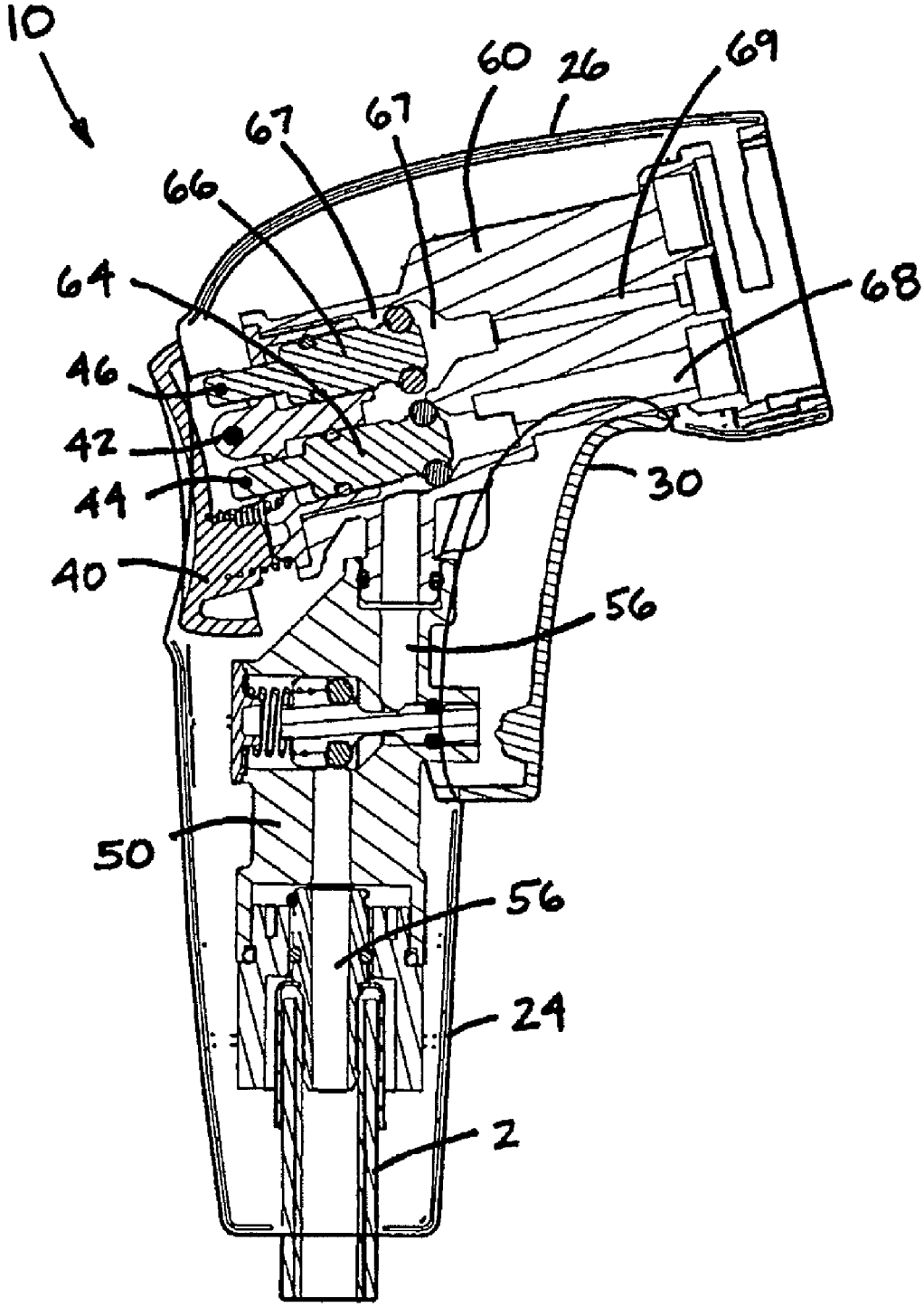
FIG. 7 is a cross-sectioned left side elevational view similar to that shown in FIG. 6 but showing the nozzle toggled to spray a combined soap or cleaner and water solution.

The second valve assembly 60 also includes a first flow conduit 68 and a second flow conduit 69 defined within it. The toggle valve cavities 65, 67 create a water flow continuum through the flow conduits 68, 69, respectively. The intended operation of the flow conduits 68, 69 is such that, when the toggle 40 is in its un-depressed position, a water flow continuum exists between the hose 2, the inlet flow conduit 56, the first valve cavity 65 of the second valve assembly 60 and through the first flow conduit 68. See FIGS. 5 and 6. When the toggle 40 is depressed, a similar continuum exists between the hose 2, the inlet flow conduit 56, the second valve cavities 65, 67, and through the second flow conduit 69, the first flow conduit 68 being effectively sealed off by the first toggle valve 64. See FIG. 7.

In this preferred embodiment, the outlet end 26 includes means for releasably receiving a cartridge 70, the cartridge 70 having an outer cartridge cap 72. The cartridge receiving means is provided by a pair of keepers 29 defined within the nozzle outlet opening 28 and by a pair of flanges 74 formed to an outer surface 71 of the cartridge cap 72. This allows for a twisting or rotating fastening action by the user. See FIGS. 2 and 4, in particular. It is to be understood, however, that the cartridge receiving means is not limited to that design and other configurations could be used that would still come within the scope of the invention.

Figure 4:
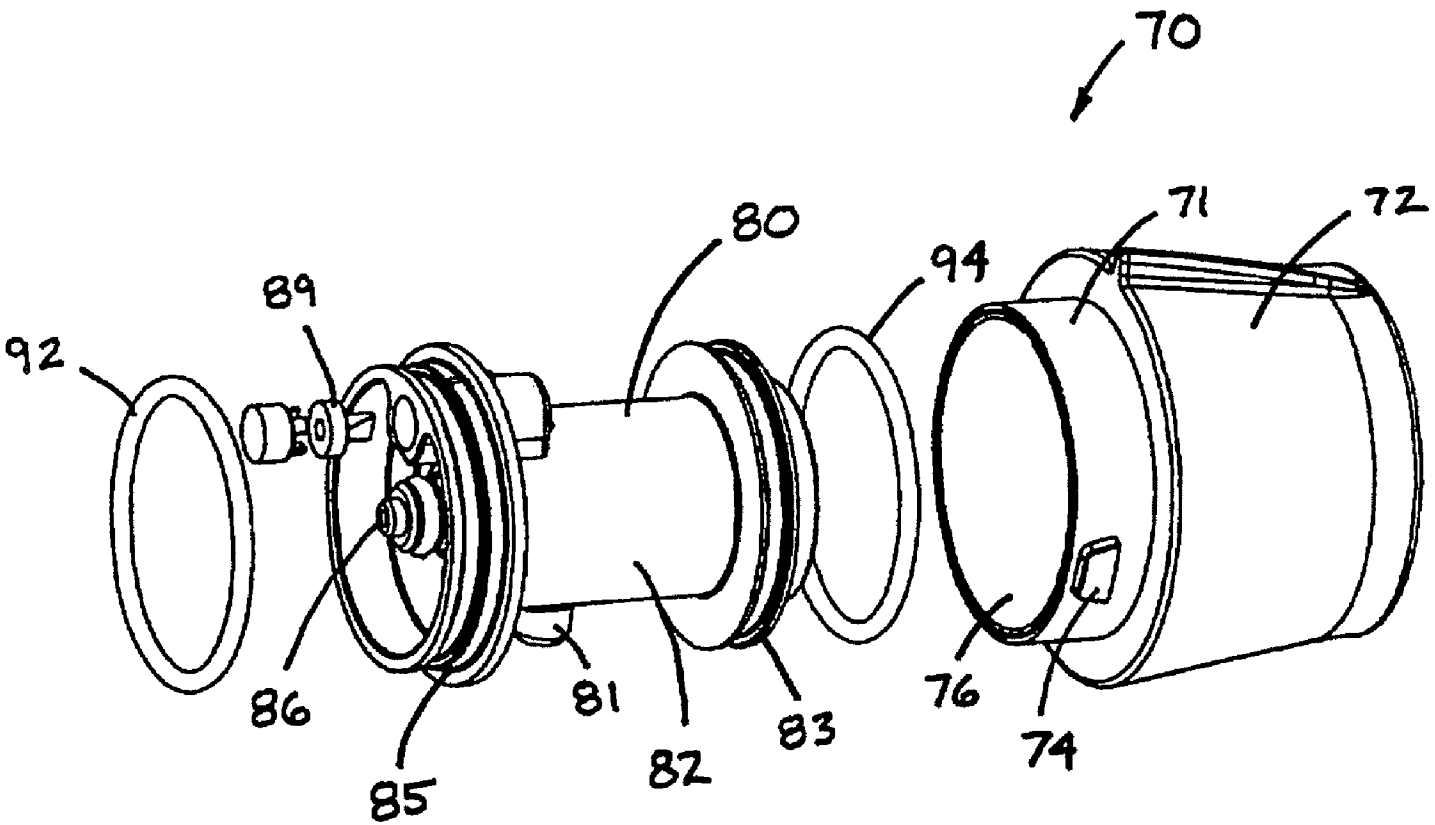
FIG. 4 is a top, rear and left side perspective and exploded view of the cartridge or nozzle portion of the spray nozzle.

Referring now to FIG. 4, it will be seen that, surrounded by the cartridge cap 72, the cartridge 70 includes a somewhat dumbbell-shaped, or hose-reel-shaped, venturi assembly 80. In the preferred embodiment, the venturi assembly 80 includes a central portion 82 that extends between a forward end 83 and a rearward end 85. The rearward end 85 includes an aperture inlet 86. The aperture inlet 86 is one end of a flow conduit 87 that runs through the length of the assembly 80 but is gradually expanded in diameter at its distal end 88. See FIGS. 5 through 7. Extending outwardly and generally perpendicularly from the assembly central portion 82 is an inlet port 81 having a venturi aperture 84 defined within it. The rearward end 85 of the venturi assembly 80 also includes a duckbill valve 89 that has a pressure sensitive opening (not shown) defined in it to allow for inlet flow through the valve 89 but which prevents outlet flow from it.

When used as intended, the venturi assembly 80 is sealingly received within the cartridge cap 72. Two sealing rings 92, 94 are used. See FIG. 4. When fully inserted, a circumferential cavity 78 is formed about the central portion 82 of the venturi assembly 80 and the inner surface 76 of the cap 72. It is in this cavity 78 that the soap or chemical is stored. As alluded to earlier, the cap 72 includes clean water outlet apertures 75 and at least one water and soap aperture 77, the former being disposed to the outer periphery of the cap 72 and the latter being disposed to the central area of the cap 72 as shown in FIG. 1.

In application, the hose 2 is connected to a water supply (not shown) and the nozzle 10 is hand held by the user. As the user depresses the forward trigger 30, a flow of water is discharged through the cap apertures 75. During this time, a water flow continuum is being formed within the nozzle body 20 where water flows through the first valve assembly 50, through the second valve assembly 60 and through the cartridge 70. More specifically, water passes through the inlet flow conduit 56, past the trigger valve 52 (which has been opened so as to allow this water flow to occur), into the second valve assembly 60 via the first toggle valve cavity 65 and the first flow conduit 68. See FIGS. 5 and 6.

As the user depresses the toggle 40, while still continuing to depress the trigger 30, the first toggle valve 64 slidingly moves within the first toggle valve cavity 65 to close off the first flow conduit 68, thereby diverting water flow into the second toggle valve cavity 67. See FIG. 7. This allows water to flow through the second flow conduit 69. Water flowing through the second flow conduit 69 then enters the aperture inlet 86 of the venturi assembly 80. This water passes through a relatively small flow conduit 87, through its expanded end 88 and out of the outlet aperture 77. As this water flows through the latter structure, a pressure differential is realized at the intersection of the flow conduit 87 and the venturi aperture 84 defined within the inlet port 81. In this fashion, water flowing at a high rate of speed and low pressure past the venturi aperture 84 tends to draw an amount of soap or chemical that is contained within the soap or chemical cavity 78 out of the cavity 78 and into the water flow, thus creating a water and soap solution that is discharged from the outlet aperture 77. The higher pressure of the cavity 78, relative to the pressure within the flow conduit 87, is maintained by virtue of the duckbill valve 89 which allows air to flow into the void created by the discharged soap or chemical from the ambient surroundings.

While the above description discloses the best mode of practicing the present invention, other alternative embodiments are also contemplated as being within the scope of the above invention. For example, the cartridge 70 can be formed of a translucent material such that an operator of the nozzle 10 can easily see whether the cartridge 70 is empty or close to empty of the chemical, such that the cartridge 70 needs to be replaced. Also, the attachment structures on the cartridge 70 to secure the cartridge 70 to the nozzle body 20 can be varied as necessary in order to provide an easy and quick connection between the respective parts of the nozzle 20. For example, the connection can be a threaded connection, as described above, or a snap-in connection, a strap connection, and the like.

Various other alternatives are contemplated as being within the scope of the following claims particularly pointing out and distinctly claiming the subject matter regarded as the invention.

The invention claimed is:

1. A hand-held cleaning spray nozzle which comprises a nozzle body including an inlet end connectable to one end of a hose, an outlet end including an outlet end opening, the outlet end opening being configured to receive a chemical dispensing assembly, said assembly having a chemical-containing cartridge disposed within it, and a water flow continuum disposed between the inlet and the outlet ends, a forwardly-disposed and finger-actuated nozzle trigger, such nozzle trigger being operable to selectively actuate a first valve assembly to permit water flow through the nozzle body, and a rearwardly-disposed and thumb-actuated nozzle toggle, the nozzle toggle being operable to actuate a second valve assembly comprising a first toggle valve and a second toggle valve, the toggle valves being movable within the second valve assembly to selectively actuate said chemical dispensing assembly to release chemical from the cartridge and into the water flow.

2. The spray nozzle of claim 1 wherein the nozzle body has a first body housing member and a complementary second body housing member, the housing members being made of a molded plastic material and being secured together to form a hollow housing of the nozzle body.

3. The spray nozzle of claim 1 wherein the first valve assembly includes an inlet flow conduit that extends between the inlet end of the nozzle body and the second valve assembly, the trigger valve being disposed to control water flow through the nozzle.

4. The spray nozzle of claim 3 wherein the second valve assembly further includes a first valve cavity and a second valve cavity, the first toggle valve being slidably movable within a first valve cavity and the second toggle valve being slidably movable within a second valve cavity, and the second valve assembly further includes a first flow conduit and a second flow conduit wherein a water flow continuum exists alternatively through the first flow conduit or through the second flow conduit.

5. The spray nozzle of claim 4 wherein the toggle is moveable between two positions, a first position that creates a flow continuum between the inlet conduit, the first valve cavity of the second valve assembly and through the first flow conduit, and a second position that creates a flow continuum between the inlet conduit, the second valve cavity of the second valve assembly and through the second flow conduit.

6. The spray nozzle of claim 5 wherein the first toggle position closes off the second flow conduit and the second toggle position closes of the first flow conduit.

7. The spray nozzle of claim 1 wherein the outlet end opening includes means for releasably receiving the chemical-containing cartridge.

8. The spray nozzle of claim 7 wherein the cartridge receiving means comprises a screw-like attachment structure.

9. The spray nozzle of claim 1 wherein the chemical-containing cartridge includes a venturi assembly, the venturi assembly including a forward end, a rearward end, and a central portion extending between the forward end and the rearward end, the rearward end including an aperture inlet, and wherein the venturi assembly further including an inlet port having a venturi aperture defined in it.

10. The spray nozzle of claim 9 wherein the rearward end of the venturi assembly includes a duckbill valve that has a pressure-sensitive opening defined in it to allow for inlet flow through the valve but which prevents outlet flow from it.

11. The spray nozzle of claim 10 wherein the chemical-containing cartridge includes an inner surface and the venturi assembly is sealingly received within the cartridge and a cavity is formed about the central portion of the venturi assembly and the inner surface of the cartridge, the cavity being adapted to retain a chemical within it and to release such chemical into the water flow upon actuation of the toggle.

12. The spray nozzle of claim 11 wherein the chemical-containing cartridge is substantially cylindrical in shape.

13. The spray nozzle of claim 12 wherein the chemical-containing cartridge is disposable.

14. The spray nozzle of claim 13 wherein the chemical-containing cartridge is made of a molded plastic material.

15. The spray nozzle of claim 14 wherein the chemical-containing cartridge is made of a translucent plastic material.

* * * * *